United States Patent [19]

Hayman

[11] Patent Number: 4,532,870

[45] Date of Patent: Aug. 6, 1985

[54] SAFE APPARATUS

[76] Inventor: Gary D. Hayman, 96 Mark David Ct., Casselberry, Fla. 32707

[21] Appl. No.: 424,032

[22] Filed: Sep. 27, 1982

[51] Int. Cl.[3] ..... E05G 1/026

[52] U.S. Cl. ..... 109/58; 109/74; 16/221; 16/250; 16/251

[58] Field of Search ..... 109/58, 74, 77, 79, 109/64; 16/221, 227, 267, 379, 250, 251; 49/381, 371, 399, 463, 464, 465, 466

[56] References Cited

U.S. PATENT DOCUMENTS

| | | | |
|---|---|---|---|
| 553,346 | 1/1896 | Mannstaedt | 109/74 |
| 1,747,836 | 2/1930 | Meilink | 109/74 |
| 2,506,422 | 5/1950 | Hecimovich | 49/371 |
| 2,576,662 | 11/1951 | Adams et al. | 49/463 |
| 2,677,910 | 5/1954 | Morgan | 40/621 |
| 3,853,371 | 12/1974 | Bienert | 16/277 |
| 3,999,876 | 12/1976 | Manchester | 16/267 |
| 4,145,978 | 3/1979 | Johnson et al. | 109/64 |
| 4,282,983 | 8/1981 | Swartzbaugh | 16/227 |
| 4,359,802 | 11/1982 | Röck | 16/251 |

FOREIGN PATENT DOCUMENTS

| | | | |
|---|---|---|---|
| 2658831 | 6/1978 | Fed. Rep. of Germany | 16/251 |
| 1571987 | 6/1969 | France | 16/251 |
| 2412676 | 8/1979 | France | 16/251 |
| 688940 | 4/1965 | Italy | 16/250 |
| 2066869 | 7/1981 | United Kingdom | 109/64 |

*Primary Examiner*—Gene Mancene
*Assistant Examiner*—David I. Tarnoff
*Attorney, Agent, or Firm*—William M. Hobby, III

[57] ABSTRACT

A security safe apparatus has a security container having an opening thereinto and a safe door covering the opening and having a combination lock thereon. The safe door is provided with a hinge for hinging the door to the security container and has a pair of hinge pins attached to the safe door and a pair of grooved hinge pin supports for nesting the hinge pins therein so that the door can be easily hinged open and lifted off the security container. Locking plates attached to the inside of the safe door extend under a safe flange to prevent entry into the safe when the safe door is closed.

8 Claims, 5 Drawing Figures

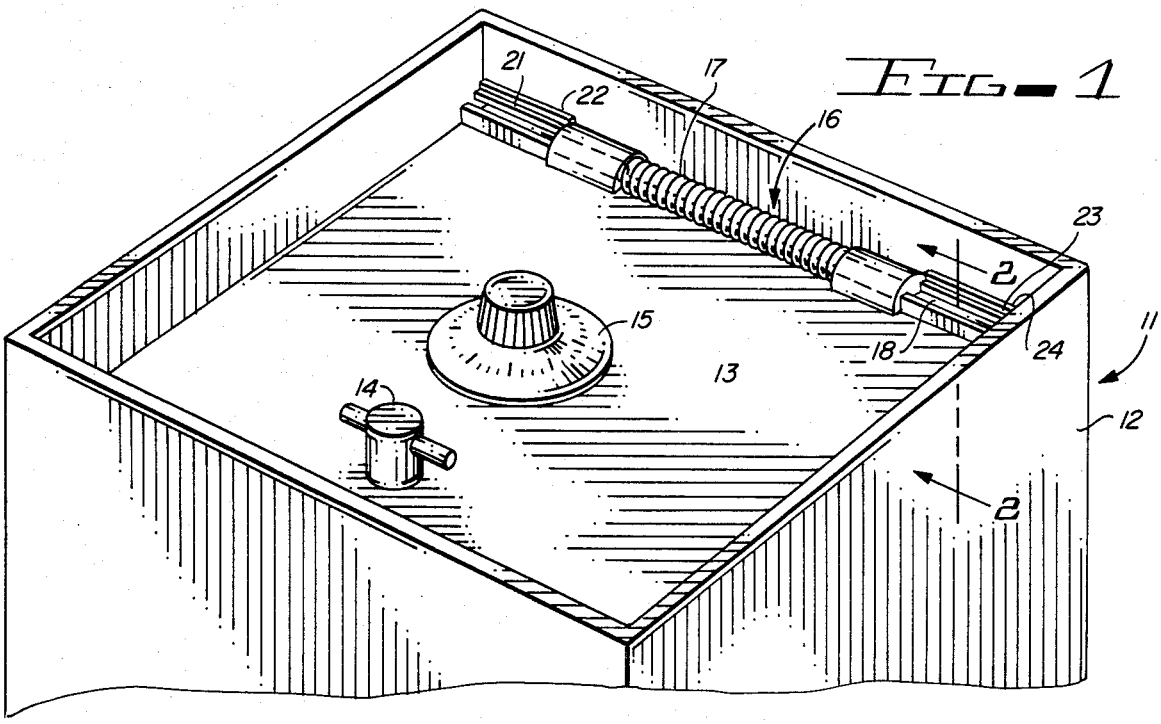
FIG. 1
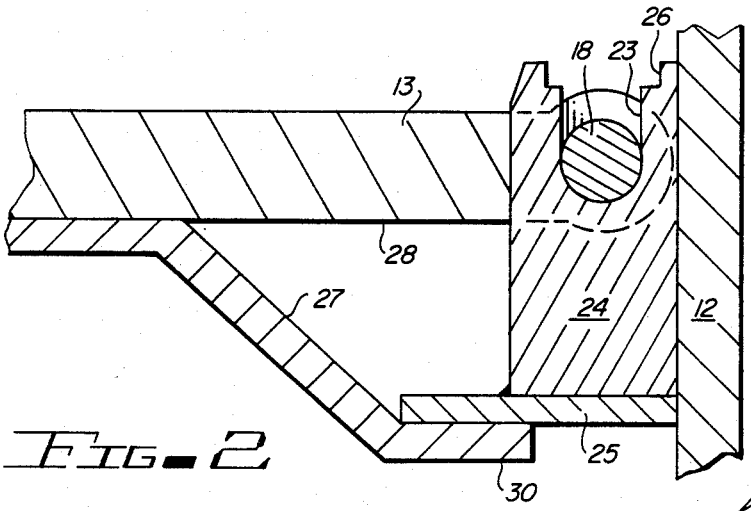
FIG. 2
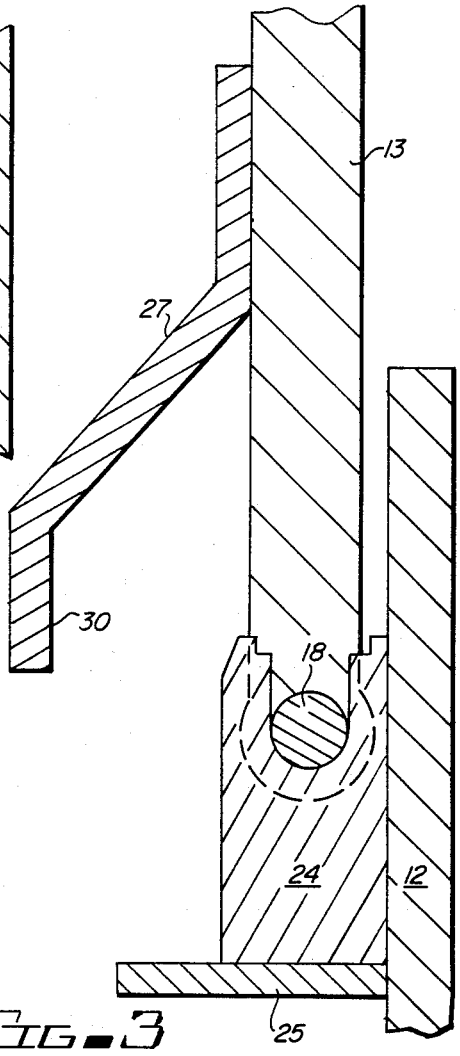
FIG. 3
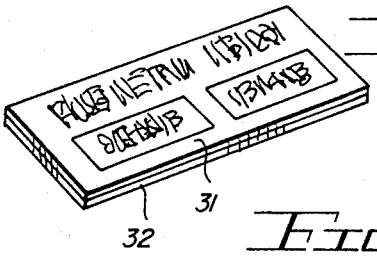
FIG. 4
FIG. 5
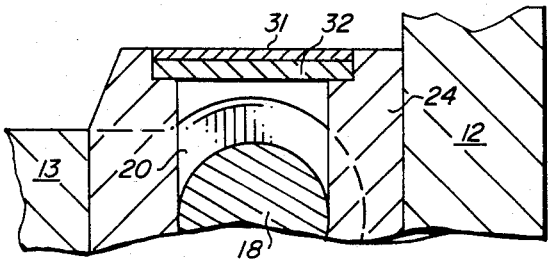

SAFE APPARATUS

BACKGROUND OF THE INVENTION

The present invention relates to safes, and especially to floor saves, which are anchored into a floor of a building.

In the past, it has been common to provide a great variety of safes for use in home, office and commerical buildings for the storage of valuables and to prevent damage to papers, and the like, in the event of a fire or other catastrophe. Typically, such safes may be free standing safes or they can be built into the wall of a building or into the floor. In the case of a floor safe, it is common to use a heavy steel security container with a recessed safe door which may be anchored in poured concrete to prevent the removal of the safe, as well as to give added insulation from heat in case of a fire. Since the floor safes are frequently made of heavy steel walls anchored in concrete, the most vulnearable portion of the safe is the door.

It has been common to use a heavier recessed safe door than the steel that might be used to make a security container and to use heavy combination locks and handle. However, depending upon the use of the safe, different thickness of safe doors may be utilized. The heavy steel doors are usually hinged to one side of the safe with a steel shaft mounted in hinge barrels mounted to the wall or to a flange of the safe. The safe can then be locked from the other side away from the hinge. However, this type of hinge makes it difficult to replace the door and it sometimes becomes desirable to change the door for demonstrations in a locksmith's display or a customer may desire to have the safe door replaced with a heavier door.

The present invention is adapted to allow the quick removal of the door from the safe and replacement of the safe door with a heavier or different door. This is accomplished by utilizing a hinge which allows the door to merely be lifted off when the door is opened and quickly replaced with the same or different door, but which is locked against the unauthorized entry through the door when the door is closed.

SUMMARY OF THE INVENTION

The safe apparatus is provided having a security container having an opening thereinto and the safe door covering the opening into the security container and having a lock thereon. A hinge for hinging a safe door to the security container includes at least one hinge pin, but preferably two, attached to the door and at least one hinge pin support grooved for nesting the hinge pin in the groove so that the safe can be easily lifted from the container by lifting the door and pins from the grooved hinge pin support. One or more locking plates are fixedly attached to the inside of the safe door and extend under a flange in the security container when the door is resting on the hinge and is closed, thus preventing the lifting of the door and hinge pin when the door is closed. Cover plates can be placed over the grooved portion of the hinge pin supports to cover the open pin and may have a piece of magnetic material attached thereto for holding the cover plates in place without interfering with the rapid removal of the door.

BRIEF DESCRIPTION OF THE DRAWINGS

Other objects, features and advantages of the present invention will be apparent from the written description and the drawings, in which:

FIG. 1 is a partial perspective view of a floor safe in accordance with the present invention;

FIG. 2 is a sectional view taken on the line 2—2 of FIG. 1;

FIG. 3 is a sectional view in accordance with FIG. 2 having the safe door in an open position;

FIG. 4 is a perspective view of a cover plate in accordance with the present invention; and FIG. 5 is a sectional view taken through the safe hinge with the cover plate in place.

DESCRIPTION OF THE PREFERRED EMBODIMENT

Referring to the drawings, a floor safe 10 is illustrated having a security container 11 having steel walls 12 and a recessed safe door 13. The recessed door 13 has a handle 14 and a combination lock 15 and is hinged with a hinge 16. The hinge 16 has a pair of hinge pins 17 and 18 mounted in a hinge barrel 20, which is part of the recessed hinge door 13. Hinge pin 17 rests in a groove 21 of a hinge pin support 22, while hinge pin 18 rests in a groove 23 of a hinge pin support 24.

As shown in FIGS. 2 and 3, the hinge pin support 24 is attached to a flange 25, which in turn is attached to the wall 12 of the security container. Support 24 may be attached to the wall 12. A hinge pin 18 is seen resting in the deep groove 23 and the hinge support can also be seen to have a pair of ledges 26 on either side of the groove 23. The door 13 is shown closed in FIG. 2 and has one or more locking plates 27 welded to the back of the door 28 and has a protruding portion 30 sticking below the door and below the flange 25 in the closed position of FIG. 2; but removed from beneath the flange 25 when the door 13 is hinged open as shown in FIG. 3. This allows the door 13 to be lifted upwards to remove it from the safe. In the closed position of FIG. 2, the locking plate 27 prevents the door 13 from being lifted, even though the hinge pins 18 are merely resting in the grooved supports.

A serial number plate 31 may have a serial number and company name thereon and may have a thin strip of magnetic material, such as commonly available magnetic polymer material, which can be glued or otherwise attached to the bottom of a plate 31 so that it then magnetically holds the plate in place on the pair of ledges 26, as shown in FIG. 5; thereby covering the open grooves 21 and 23 to give a neater appearance and to make the hinge pins appear to be in a hinge barrel. However, since the plates 31 are only lightly held by the magnetic material or may be held by gravity or friction, or any other method desired, the door 23 can be opened and rapidly pulled up with or without removing the plates 31 first.

It should be clear at this time that a floor safe has been provided which allows for the rapid change of the safe door. It should, however, also be clear that the present invention should not be limited to the forms shown, which are to be considered illustrative rather than restrictive.

I claim:

1. A safe apparatus comprising in combination:

a security container having an opening thereinto;

a safe door covering said opening into said security container and having a lock attached thereto;

hinge means for hinging said safe door to said security container, said hinge means having at least one hinge pin attached to said door and a hinge pin support grooved for nesting said hinge pin therein, said hinge pin support groove being open along one side thereof at least the width of the diameter of said hinge pin to allow said safe door to be removed from said security container by separating said hinge pin from said grooved support upon lifting an opened safe door; and means for preventing the separation of said safe door from said container when said safe door is closed.

2. A safe apparatus in accordance with claim 1, in which said hinge means includes a pair of hinge pins each nesting in a groove of a grooved hinge pin support.

3. A safe apparatus in accordance with claim 2, in which a cover plate covers said groove of said hinge pin support.

4. A safe apparatus in accordance with claim 3, in which said cover plate has magnetic material attached theretor for holding said cover plate over said groove in said hinge pin support.

5. A safe apparatus in accordance with claim 1, in which said means for preventing the separation of said safe door from said container includes at least one locking plate fixedly attached to the inside of said safe door and extending under a flange along one wall of said safe when said safe door is closed and swinging out from under said flange when said door is opened.

6. A safe apparatus in accordance with claim 5, in which said flange attached to said security container wall has said hinge means hinge pin support attached thereto.

7. A safe apparatus in accordance with claim 6, in which said safe door has a handle and lock thereon.

8. A safe apparatus in accordance with claim 7, in which each said hinge pin support has an elongated groove therein and has a pair of recessed ledges along each side of said groove to support said cover plate on said pair of ledges.

* * * * *